US005938193A

United States Patent [19]

Bluemle et al.

[11] Patent Number: 5,938,193

[45] Date of Patent: Aug. 17, 1999

[54] METHOD AND APPARATUS FOR ALIGNING MOVING FLAT ARTICLES WITH AN ALSO MOVING ALIGNMENT MEMBER

[75] Inventors: Martin Bluemle, Horhausen; Engelbert Rottmann, Andernach, both of Germany

[73] Assignee: Winkler & Duennebier Maschinenfabrik und Eisengiesserei KG, Neuwied, Germany

[21] Appl. No.: 08/815,568

[22] Filed: Mar. 12, 1997

[30] Foreign Application Priority Data

Mar. 14, 1996 [DE] Germany ..... 196 09 991

[51] Int. Cl.[6] ..... B65H 9/04

[52] U.S. Cl. ..... 271/243; 271/196; 271/276

[58] Field of Search ..... 271/243, 196, 271/276, 244, 245, 246, 235, 226, 234

[56] References Cited

U.S. PATENT DOCUMENTS

| | | | |
|---|---|---|---|
| 2,944,812 | 7/1960 | Winkler et al. | 271/243 |
| 3,199,864 | 8/1965 | Irvine . | |
| 3,281,144 | 10/1966 | Turner et al. | 271/243 |
| 4,043,551 | 8/1977 | Morrison et al. | 271/243 |
| 4,062,538 | 12/1977 | Stange et al. | 271/243 |
| 5,374,053 | 12/1994 | Doucet et al. | 271/243 |

FOREIGN PATENT DOCUMENTS

| | | | |
|---|---|---|---|
| 876527 | 5/1953 | Germany . | |
| 1761435 | 10/1970 | Germany . | |
| 2650438 | 6/1977 | Germany . | |
| 4114479 | 12/1992 | Germany . | |
| 57-4853 | 1/1982 | Japan | 271/243 |
| 3-259860 | 11/1991 | Japan | 271/243 |

OTHER PUBLICATIONS

Looney, John Copy Sheet Registration System, Xerox Disclosure Journal. vol. 1, No. 5, pp. 85–86, May 1976.

*Primary Examiner*—William E. Terrell
*Assistant Examiner*—Patrick Mackey
*Attorney, Agent, or Firm*—W. F. Fasse; W. G. Fasse

[57] ABSTRACT

Flat articles such as letter envelopes or letter envelope blanks or the like are aligned for further processing by transporting the articles through an alignment path with the help of a pulling mechanism that seizes or entrains each individual article along its leading edge as viewed in the transport direction and moves the article by pulling the article against a stop member or members which are also moved, but with a slower speed than the pulling of the article. Once the leading edge of the article bears against the stop member or members, the article is aligned and ready for further processing. The entraining or seizing takes place in an area positioned substantially centrally along the leading edge of an article between ends of the leading edge of an article.

16 Claims, 8 Drawing Sheets

DRIVE FOR SHAFT 20
REDUCED PRESSURE SOURCE
IV
IV
III
14
17
17'
18
18'
16
16'
19
19
20
21
21
24
24
25
25
26
27
28
29
30
31
32
33
34
34
34A
35
35
36
37
38
39
40
41
43
44
45
46

METHOD AND APPARATUS FOR ALIGNING MOVING FLAT ARTICLES WITH AN ALSO MOVING ALIGNMENT MEMBER

FIELD OF THE INVENTION

The invention relates to a method for aligning moving flat articles such as letter envelopes relative to an also moving alignment or stop member. The invention also relates to an apparatus for performing the present method.

BACKGROUND INFORMATION

German Patent Publication DE 876,527 (Mailänder), published on Sep. 4, 1952 discloses a method and apparatus for aligning sheet metal plates and cardboard panels or the like in lacquer-applying machines or printing machines. The articles to be aligned first are caused to travel along an alignment path with a speed which is larger than the speed of two stop members which extend crosswise to the feed advance direction and at a spacing from each other. The articles are pushed against these stop members.

As soon as the article abuts against one or both stop members, the article is aligned relative to the position of the stop members and the speed of the article is reduced to that of the stop members. Thus, the articles are brought into an exact position and their movement is synchronized with the work sequence of the machine in which the article is further treated for example by finishing steps. The stop members that travel along precise positions and in synchronism with the machine for further treatment are advanced in the known apparatus with chain drives, the upper run of which is located in the same plane in which transport chains for the article to be aligned travel. The transport chain entraining elements grip the articles at their rear end and run faster than the chains carrying the stop members, thereby pushing the articles against the stop members. The known apparatus and its components are so arranged for mutual cooperation that the articles to be aligned bear against or abut against the stop members before the articles are transferred to the machine for further treatment or finishing steps.

German Patent Publication 1,761,435 (Fischer et al.), published on Oct. 1, 1970 relates to a method and apparatus for the fitted alignment and supply of flat articles such as sheets of paper to machines that further process these sheets. The arrangement and construction is basically the same as in the above-described German Patent Publication 876,527, however, with the exception that in the device of Fischer et al. the flat sheets which are to be aligned in a fitted manner, overlap each other in the manner of fish scales which are transported to the input of a sheet processing machine such as a printer. The spacing from one leading edge to the next leading edge of the overlapping sheets is larger than the distance between stop members travelling in the transport direction. These stop members travel also in synchronism of the further processing machines so that each sheet is pushed by its faster running feeding device against stop members for alignment by the stop members and for application of a brake force by the stop members to the sheets. The sheets prior to reaching the stop members, rest on a transport belt where the sheets are held in place by gravity and by the overlapping in a fish scale manner, whereby a certain press down force is maintained. Following the sheet alignment, the sheets are taken over by the further processing machine or are fed into this machine sheet-by-sheet in single sheet feeding fashion.

German Patent Publication DE 4,114,479 (Greive), published on Dec. 17, 1992 discloses a method and apparatus for feeding, aligning, and holding of sheets for sheet processing machines such as the printing section of an offset sheet printing machine. Here again the method described above is basically employed in that sheets or articles to be aligned are caused to bear against brake force applying stop members so that the sheets assume the desired aligned position in response to a pushing force.

U.S. Pat. No. 3,199,864 (Irvine), issued on Aug. 10, 1965 discloses a document handling device for synchronizing the movement of a plurality of documents so that a predetermined spaced relationship exists between successive documents. Irvine is not concerned with properly aligning articles relative to an aligned position. Irvine is also not concerned with timing or synchronizing the document feeding with an operational sequence of another machine. Irvine discloses a rotating entraining member and a bow-shaped guide track partially surrounding the rotating entraining member. A plurality of guide rollers are so arranged that they can reach partially through respective openings in the guide track. The articles are supplied to the apparatus by a transport mechanism feeding the articles tangentially to the entraining member so that the articles enter into a gap between the rotating entraining member and the guide track or rather the guide rollers. A stop member rotating in the same direction as the rotating entraining member is arranged for a cooperation with the entraining member. The rotating stop member rotates somewhat slower than the entraining member which thus accelerates the articles until they are pushed against the entraining member. The entraining member itself is constructed as a rotating lever or as a rotating roller. The arrangements of components is such that the articles exit from the apparatus with uniform spacings between neighboring articles in a row. The apparatus is not suitable for an exact alignment of an article relative to a stop member or stop members because the articles can bear simultaneously against the entraining member and against two or more guide rollers so that the articles are not actually freely movable. Such a free movement, however, is necessary for the positional and timely alignment of the articles relative to an operational sequence of a further processing machine.

German Patent Publication DE 2,650,438 C2 (Irvine et al.), published on Jun. 16, 1977, discloses an apparatus for individually feeding single sheets from a stack. The sheets may have different thicknesses and several separator stations are arranged in a row.

OBJECTS OF THE INVENTION

In view of the above it is the aim of the invention to achieve the following objects singly or in combination:

- to provide a method and apparatus that is capable of aligning various types of articles such as letter envelopes, blanks for making letter envelopes, flat bags and blanks for making flat bags in a positional sense as well as in a timing sense;
- the method and apparatus shall operate reliably to avoid jamming while gently treating the sheets;
- the apparatus shall have a simple construction so as to minimize or virtually eliminate wear and tear while simultaneously being capable of a high-speed operation for handling large numbers of flat articles;
- to avoid pushing or pressing articles against a stop member to avoid damaging the articles; and
- to handle large numbers of articles at high speed while simultaneously minimizing down-times.

SUMMARY OF THE INVENTION

According to the method of the invention articles to be aligned such as flat letter envelopes or the like are moved along an alignment path by first seizing each article at least in the area of its leading edge as viewed in the feed advance direction and by pulling the article until the leading edge is pulled against a stop member which is also moving, but at a speed slower than the pulling speed of the article. It has been found that pulling, as compared to the conventional pushing or pressing has the advantage that the trailing edge of an article can freely follow and thus align in the same way as the leading edge if the latter is pulled against a stop member or members. This feature of the invention substantially reduces production down-times even if large numbers of articles are pulled at a high production speed through the alignment station.

The apparatus according to the invention is equipped with at least one pulling device that seizes the leading edge of an article for pulling the article in the feed advance direction at a speed exceeding the traveling speed of a stop member or members. The pulling device can be realized for example by a suction air providing pulling element, by electrostatically operating pulling elements, or by magnetic pulling elements for example where the leading edge of sheets is provided with a magnetized element or elements such as dots, strips, or the like. These pulling devices are precisely controllable especially with regard to the holding and pulling force along the leading edge of the sheets to be aligned. Thus, a larger pulling force can, for example, be applied to heavier sheets than to lighter sheets and damage to the sheets is avoided.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
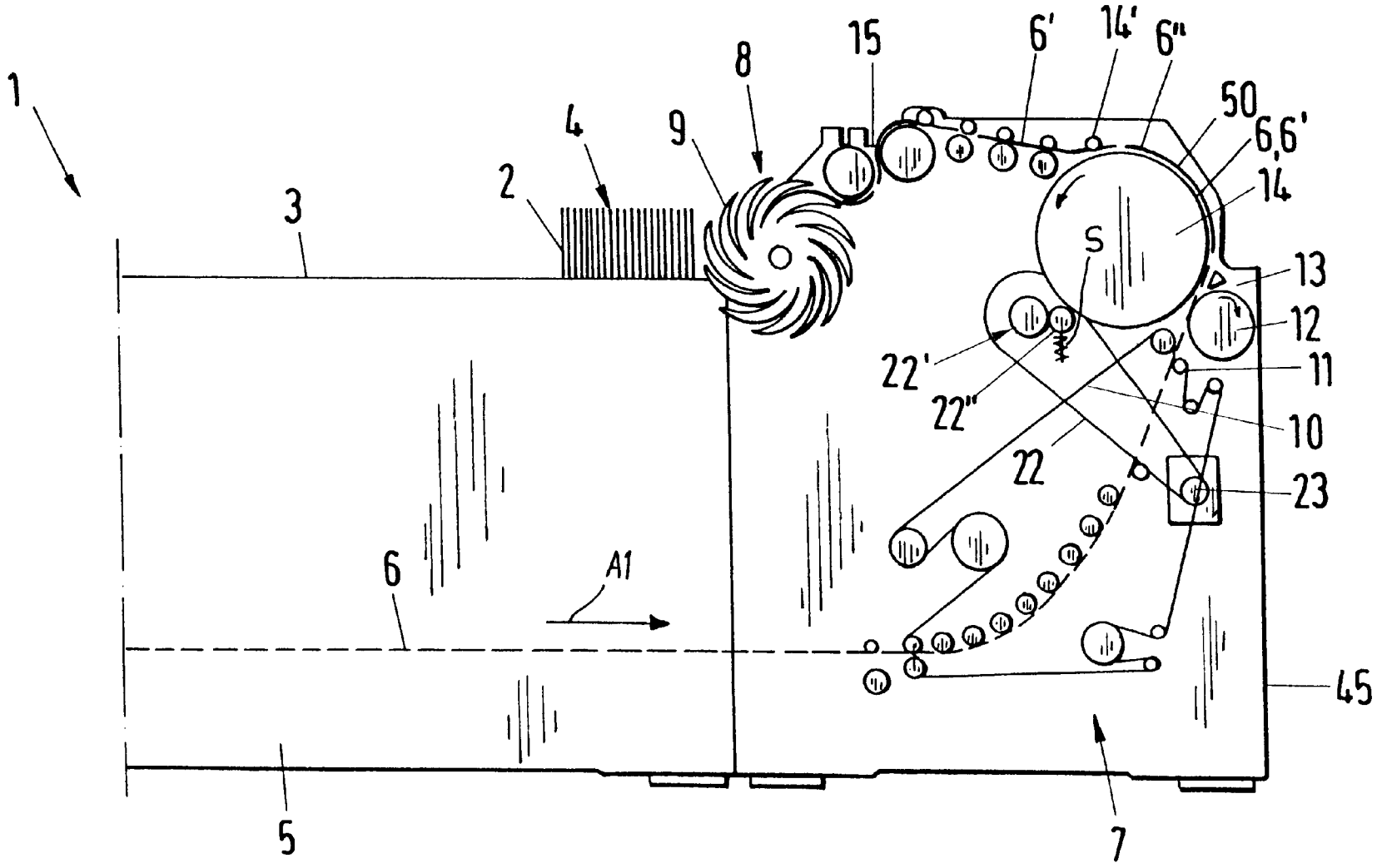
FIG. 1 is a schematic side view of essential components of an apparatus for producing letter envelopes for example cooperating with an alignment mechanism having a rotating circular alignment path according to an invention.

FIG. 1 shows an apparatus 1 for producing flat relatively easily flexible articles 6' that are assembled into stacks 4 as letter envelopes 2. The apparatus comprises several stations. Article blanks 6 travel in the feed advance direction shown by arrow A1 through a drying station 5 for drying gummed portions of the blanks 6 which have been provided with adhesive in a station not shown but positioned upstream of the station 5. The blanks 6 emerging from the station 5 are partially finished and travel into an article finishing station 7 in which the articles such as letter envelopes are completed and then supplied to a collecting station including a stacking table 3 where the stacks 4 of envelopes 2 are formed. The stacking can, for example, be performed by a stacking mechanism 8 including a compartmented disk 9 holding individual envelopes in its compartments.

Referring further to FIG. 1, the almost completed envelope blanks 6 are transported by a known transport mechanism such as conveyors, that move the blanks 6, for example, in a staggered arrangement through the drying station 5. At the exit of the drying station 5 the dried blanks are taken up by transport belts 10 and 11 which bring the partially finished blanks to an extraction and sheet separation roller 12 positioned for cooperation with the alignment mechanism 14 according to the invention. Individual blanks are then supplied to the alignment mechanism 14 with the help of the separation roller 12. Preferably, a switch 13 is positioned between the roller 12 and the alignment mechanism 14 for removing blanks that are defective and hence could cause trouble such as jamming in the operation of the system. The blanks 6 travel with their bottom fold facing in the feed advance direction A1 for drying in the station 5. In this position the blanks also reach the separation roller 12.

The alignment mechanism 14 is positioned downstream of the separation roller 12 as viewed in the feed advance direction of the blanks 6. The blanks are transported to a final processing step in a folding device 15 where the closure flaps of the blanks are provided with the respective fold. After this final step the envelopes 2 are finished and taken over by the compartmented disk 8 for deposition in the stack 4 on the stacking table 3.

The alignment mechanism 14 comprises an entraining element 16 for the envelope blanks 6 and at least one carrier 17 or preferably two carriers 17, 18 for a stop member or stop members 19. The entraining element 16 comprises a transport disk or drum 16' and the carrier 17, 18 comprise two support disks 17' and 18'. The transport disk or drum 16' is arranged between the support disks 17' and 18' as shown in the example embodiment illustrated in FIG. 2, whereby a blank 6 can be seized preferably centrally along its leading edge between the ends of the blank 6.

Referring further to FIG. 1, the alignment mechanism 14 cooperates with transfer rollers 14' in order to assure an operation free of trouble in the alignment of the blanks 6. These transfer rollers 14' are spring biased and press against the support disks 17' and 18' for receiving an aligned letter envelope 6' for further transport in accordance with the timed sequence of a feed advance cycle. Without the transfer rollers 14' it would be possible for the articles to continue travelling with the circumferential speed of the transport disk or drum 16' as soon as the stop members 19 pass in their rotational travel below a point where they no longer engage a leading edge of an envelope blank 6, because the rotational speed of the transport disk or drum 16' is higher than the circumferential speed of the support disks 17' and 18'. This resumption of the higher speed by the articles is undesirable and prevented by the transfer rollers 14' which make sure that the blanks do not resume travelling with the higher circumferential speed once they have been aligned by being pulled against an alignment or stop member or members 19.

The two support disks 17' and 18' are driven by a shaft 20 on which these disks are mounted for rotation with the shaft. The transport disk or drum 16' is also mounted on this shaft 20, however by bearings 21 so that the transport disk or drum 16' is rotatable on the shaft 20 and can thus be driven by its own drive 22 with a larger r.p.m. than the r.p.m. of the shaft 20 and of the support disks 17', 18'.

As shown in FIG. 1, the drive 22 comprises a friction roller 22' driven by a motor 23 through a belt, chain or the like. The driving force of the friction roller 22' is transmitted to the transport disk or drum 16' through a spring biased friction wheel 22" by a spring S which biases the wheel 22" into the gap between the drive roller 22' and the transport disk or drum 16'. This drive makes it possible to let the shaft 20 and the support disks 17', 18' operate with the same r.p.m. as the machine while the transport disk or drum 16' positioned between the support disks, rotates at a higher r.p.m.

Figure 2:
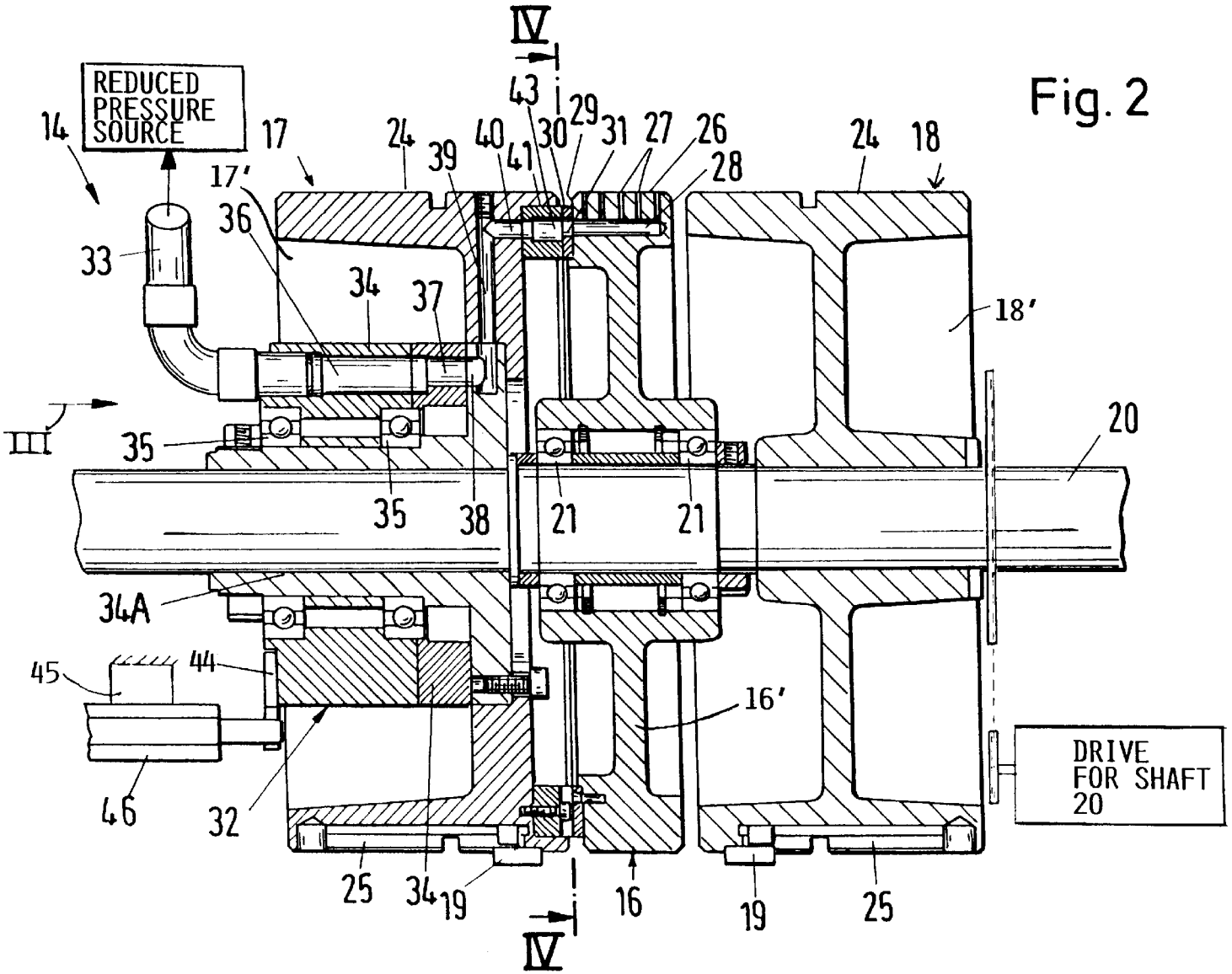
FIG. 2 shows an axial sectional view, on an enlarged scale, of the alignment mechanism according to the invention for example for aligning partially completed letter envelopes and including a suction head.
Figure 3:
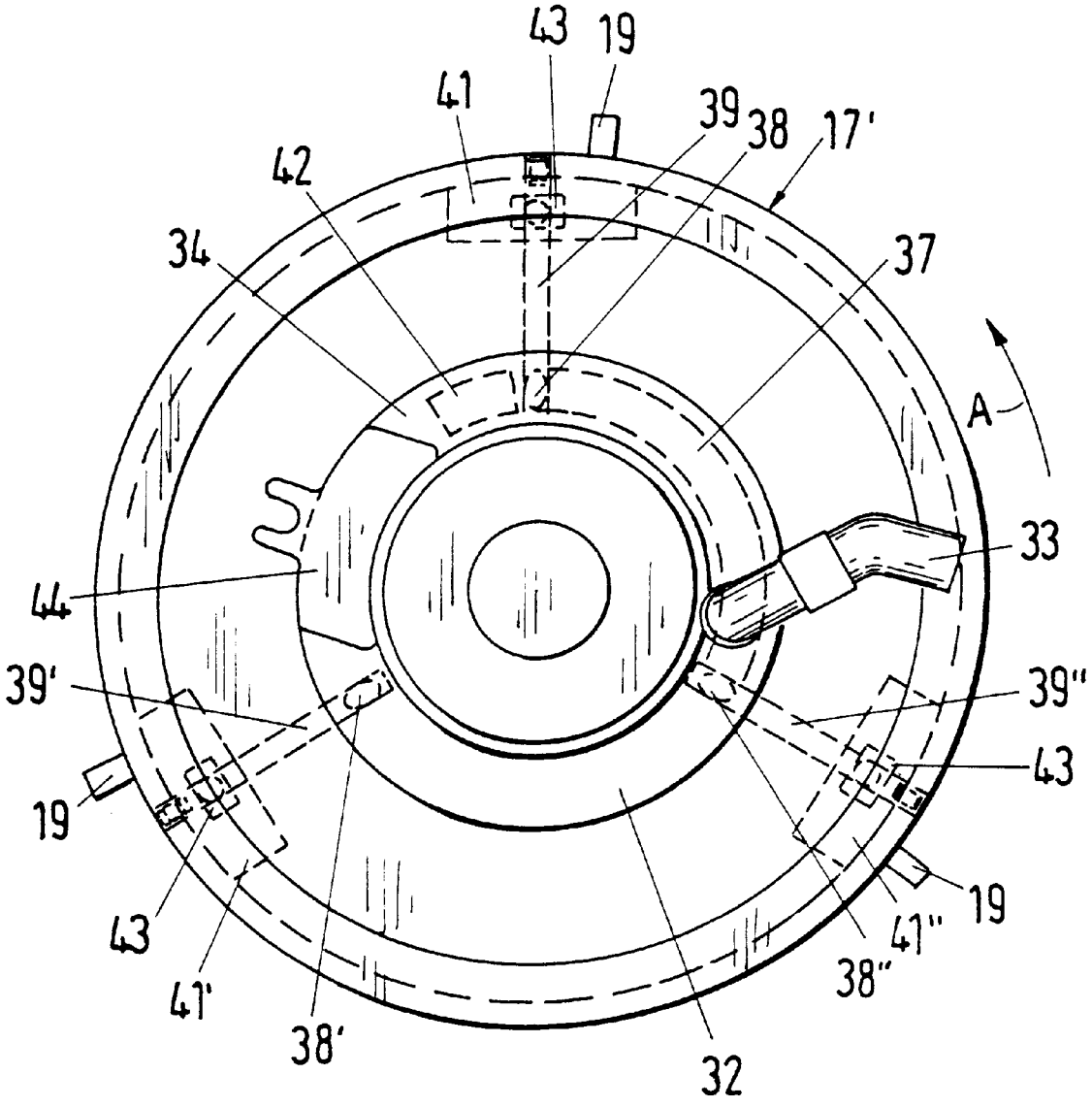
FIG. 3 is a view in the direction of the arrow III in FIG. 2 whereby the suction head has been rotated by 90° relative to its position in FIG. 2.

FIGS. 2 and 3 shows an example embodiment in which each of the support disks 17' and 18' carries three stop members 19 uniformly distributed around the circumference 24 of these disks 17', 18'. Each of these stop members 19 is adjustable in its position in a direction parallel to the longitudinal axis of the shaft 20 by an adjustment mechanism 25 such as a spindle or the like. This adjustment accommodates sheets of different sizes.

Figure 4:
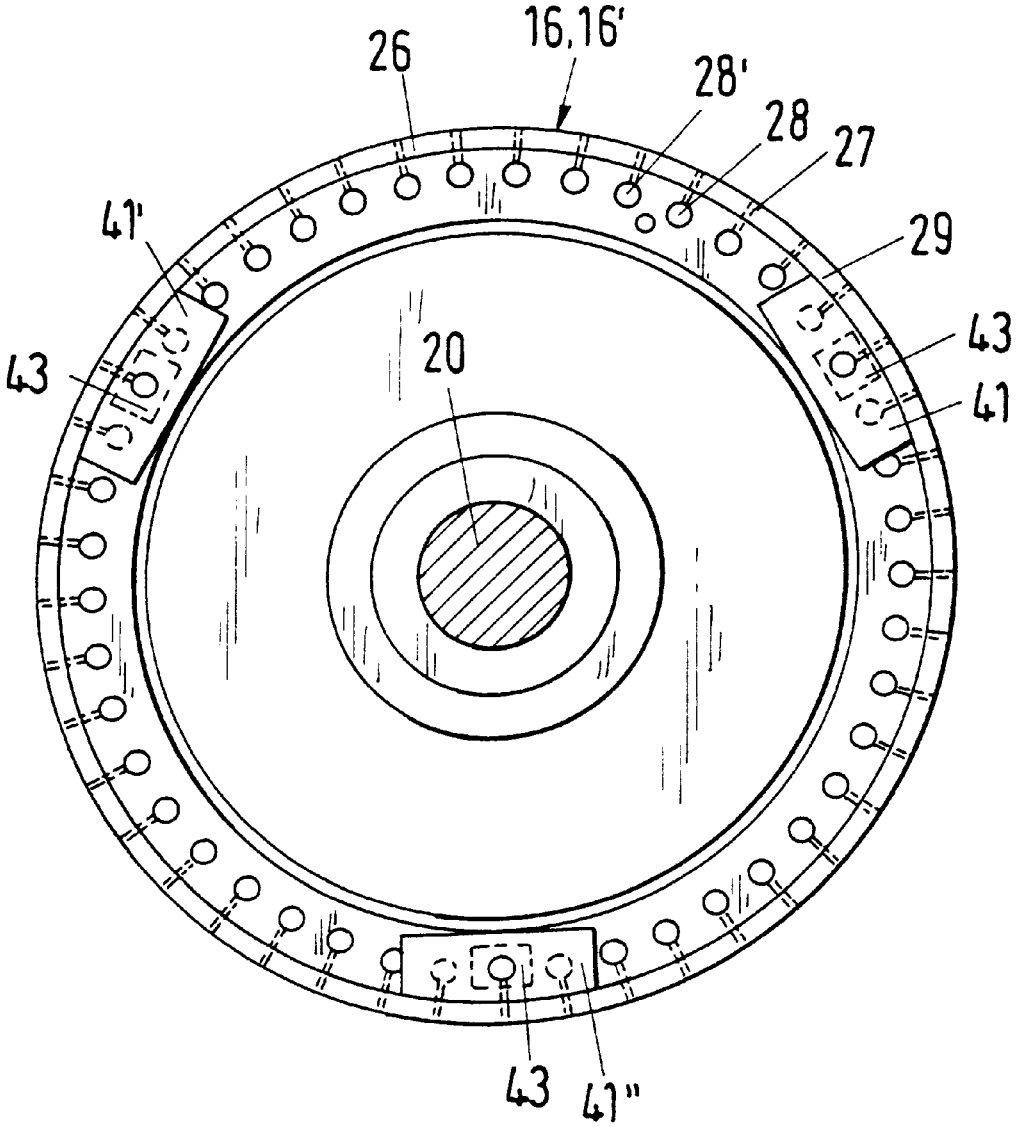
FIG. 4 is a sectional view along section line IV—IV in FIG. 2.

As shown in FIGS. 2 and 4, the transport disk or drum 16' is provided in its circumferential rim 26 with radially directed suction openings 27 for applying a suction force to the leading edge of each sheet. This suction force is provided by an evacuation source not shown to reduce the pressure effective at the suction openings 27 to a value below atmospheric pressure sufficient to seize the leading edge of sheets. The suction force is sufficient so that the transport disk or drum 16' can function as an entraining member 16 by seizing the article 6' at its leading edge to thereby entrain the article with the circumferential speed of the transport disk or drum 16'. The suction applied through the openings 27 pulls the article 6' until the leading edge 6" thereof bears against one or two stop members 19 which apply a brake force to the article to slow it down to the speed of the support disks 17' and 18', whereby the article becomes properly aligned. Since the transport disk or drum 16' is positioned between the support disks 17' and 18' of the carriers 17 and 18, the suction openings 27 are preferably also positioned centrally between the ends of an article 6 transported by both carriers 17 and 18.

The diameter of the transport disk or drum 16' is so dimensioned that it is suitable to align at least one, preferably several articles 6' with each revolution of the transport disk or drum 16'. For this purpose the suction openings 27 are aligned in rows extending parallel to the longitudinal axis of the shaft 20. These rows of suction holes 27 are operatively connected to suction channels 28, also extending in parallel to the longitudinal shaft axis. As viewed in FIG. 2 the right-hand end of the suction channels 28 is closed while the left-hand end is open in the facing side 29 of the transport disk or drum 16'. Preferably, a ring disk 30 with bores 31 is secured to the left-hand axially facing side of the transport disk or drum 16'. The bores 31 are axially aligned with the respective suction channels 28.

In order to connect the suction openings 27 through the suction channels 28 in the transport disk or drum 16' with a source of reduced pressure for providing suction air during operation, it is necessary to provide a continuous suction path between the bores 31 and the reduced pressure source at least temporarily. A stationary suction head 32 is provided for this purpose. As shown in FIG. 2, the suction head 32 is mounted on the shaft 20 by bearings 35 so that the suction head 32 may remain stationary when the shaft 20 rotates. A pipe 33 is connected to the suction head 32. A control valve 34 communicates the suction head 32 through a suction control channel 37 and through a control window 38 with a radially oriented bore 39 and an axially extending hole 40 in the support disk 17'. The hole 40 is positioned to face the axially facing side of the transport disk or drum 16' through a suction hole 43 in a suction segment 41. The support disk 17' is mounted with its hub 34A on the shaft 20 for rotation therewith. The hub 34A carries the above mentioned bearings 35, preferably ball bearings, which support the stationary suction head 32 provided with a bore 36 in the control valve 34. The bore 36 communicates with the suction pipe 33 which in turn is connected to an exhaust fan not shown. A control channel having an opening of about or slightly more than 90° in the circumferential direction is positioned to communicate with the bore 36 on the one hand and with a control window 38 on the other hand. The control window 38 is provided in the hub 34A and thus rotates with the shaft rotation. The window 38 further communicates through the bore 39 extending radially and through the hole 40 extending axially with a suction segment 41 which in turn communicates with the suction channels 28 through the hole 43 and the channel 28 in the transport disk or drum 16'.

In operation, when the control window 38 passes along the suction control channel 37 as the hub 34A rotates, reduced pressure is applied to the suction openings 27 in the circumference 26 of the transport disk or drum 16'. This suction is maintained as long as a portion of the window 38 remains in alignment with the control channel 37. As soon as this alignment disappears because the window 38 keeps rotating, the suction is stopped, since the control window 38 now moves into alignment with a vented opening 42 in the control valve 34 as shown in FIG. 3. This alignment between the opening 42 and the control valve 34 takes place as soon as the support disk 17', during its rotation in the direction of the arrow A, shown in FIG. 3 moves out of the range of the control channel 37 and into the range of the vented window 42 of the control valve 34. Thus, the application of reduced pressure to the suction openings 27 takes place periodically during each revolution of the support disk 17'.

FIG. 3 further shows that the support disk 17' carries three stop members 19 angularly evenly spaced around the disk 17'. The support disk 18' not seen in FIG. 3, also carries three stop members 19 positioned in alignment with the stop members 19 of the disk 17'. However, only the support disk 17' is equipped with three suction control windows 38, 38', and 38" and with the corresponding radially directed bores 39, 39' and 39" as well as with the suction segments 41, 41' and 41" as best seen in FIG. 3.

Each suction segment 41, 41', 41" has a respective suction window 43 so dimensioned that its cross-sectional flow area overlaps for cooperation with at least one suction channel 28 in the transport disk or drum 16' completely or it overlaps two neighboring suction channels 28, 28' at least partially.

The transport disk or drum 16' positioned centrally between the support disks 17' and 18', is equipped with at least one preferably several rows of suction openings 27 for seizing and pulling articles 6' into alignment against the slower moving stop members 19. A plurality of suction hole rows would be arranged in parallel to each other and circumferentially spaced around the circumference of the transport disk or drum 16'. The cross-section of the suction openings 27 has preferably a circular cross-section or a slotted cross-section. Circular cross-sections are preferred for manufacturing reasons.

To make sure that the suction head 32 is stationary together with the suction pipe 33 leading to a suction source not shown, at least one holding element 44 is rigidly secured to the hub 34. The holding element 44 in turn cooperates with a holding arm 46 rigidly secured to the machine frame 45 as shown in FIG. 2.

Referring further to FIGS. 1 to 3, the alignment of the articles 6, 6' takes place along a curved alignment path 50 shown in FIG. 1. The alignment path 50 comprises a track section having a circular segmental configuration for cooperation with the cylindrical circumference of the rotating transport disk or drum 16' and also for cooperation with the cylindrical surface of the two support disks 17' and 18'. While the circular curvature of the alignment path 50 is convenient and preferred, the invention is not limited to a circular alignment path. Alignment paths with other configurations may be used, for example a flat alignment path 50' can be constructed as will be described below with reference to FIGS. 5 to 8.

FIGS. 5 to 8 illustrate an alignment mechanism 1A with a plane alignment path 50'. Components that are substantially the same in both embodiments are provided with the same reference numbers.

Figure 5:
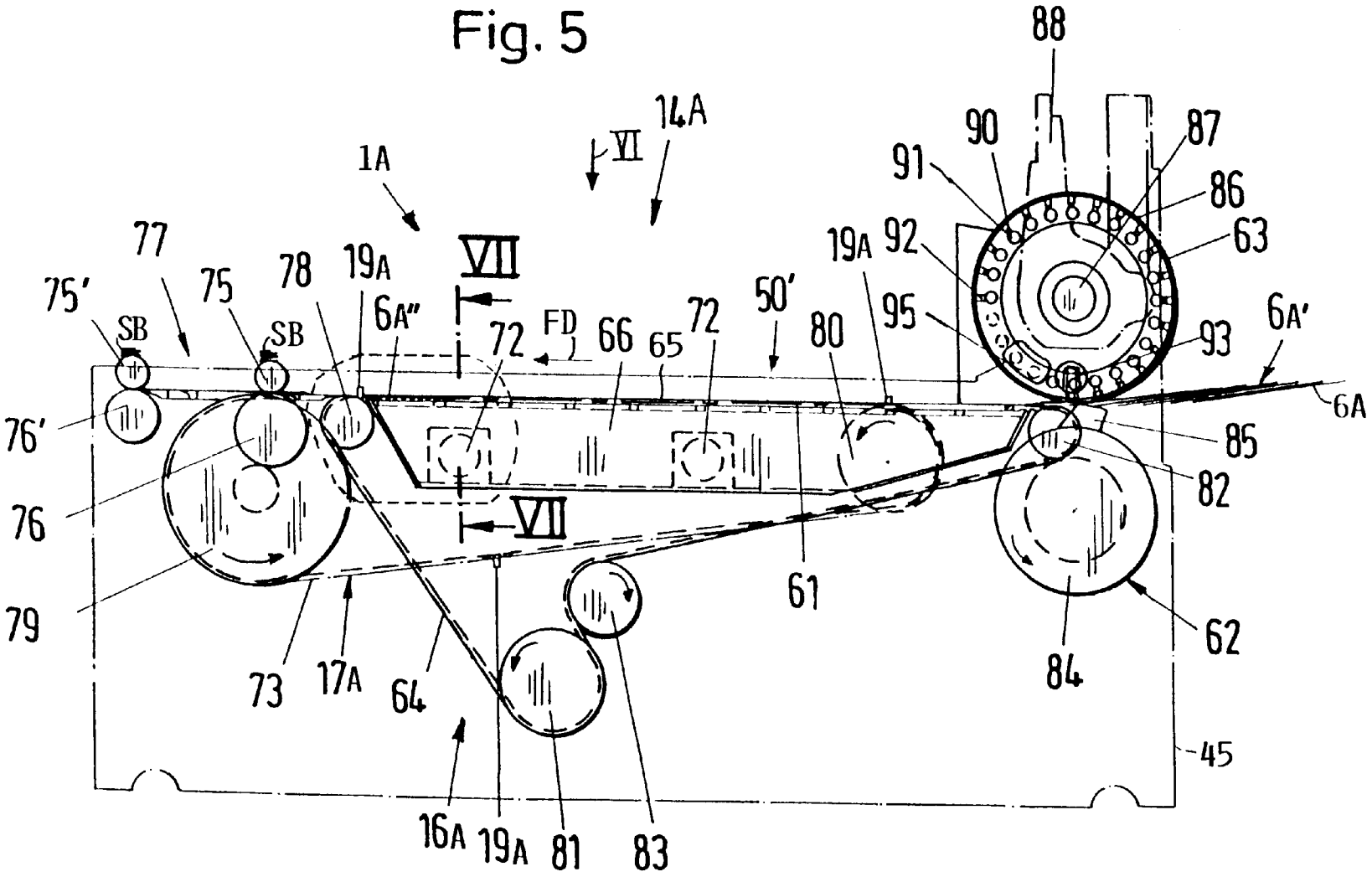
FIG. 5 is a schematic side view of a modified embodiment of an alignment apparatus with a horizontal plane alignment path according to the invention.

The alignment mechanism 14A is constructed for aligning articles 6A' such as letter envelope blanks. These articles come, for example, from a dryer not shown, but are arranged to the right of the section shown in FIG. 5. The articles 6A or 6A' travel from right-to-left in the feed advance direction in FIG. 5 as indicated by the arrow FD. The articles 6A, 6A' are oriented with their closure flaps trailing relative to the feed advance direction FD from right to left as seen in FIG. 5. The articles are also supplied in a staggered relationship relative to each other as shown at the right-hand side of FIG. 5 to facilitate the separation of individual articles by the cooperation of a segment carrying roller 62 and a suction roller 63. The segment roller 62 is arranged in the machine frame 45 below a working plane 61. The suction roller 63 is arranged above the working plane 61. The segment roller 62 is axially relatively short and comprises at least one disk carrying at least one radially projecting separation segment 85. The suction roller 63 is arranged above the working plane 61 and is preferably mounted for tilting on arms 88 to move the suction roller 63 out of the way when necessary. The rollers 62 and 63 cooperate for removing the articles 6A, 6A' individually from the supply and moving the articles onto the working plane 61, whereby the articles are accelerated and transferred onto an entraining mechanism 16A comprising at least one transport gear belt 64, the upper run 65 of which forms the working plane 61 and additionally defines an alignment path 50' travelling at a defined speed from right-to-left in FIG. 5 in the feed or transport direction.

Figure 6:
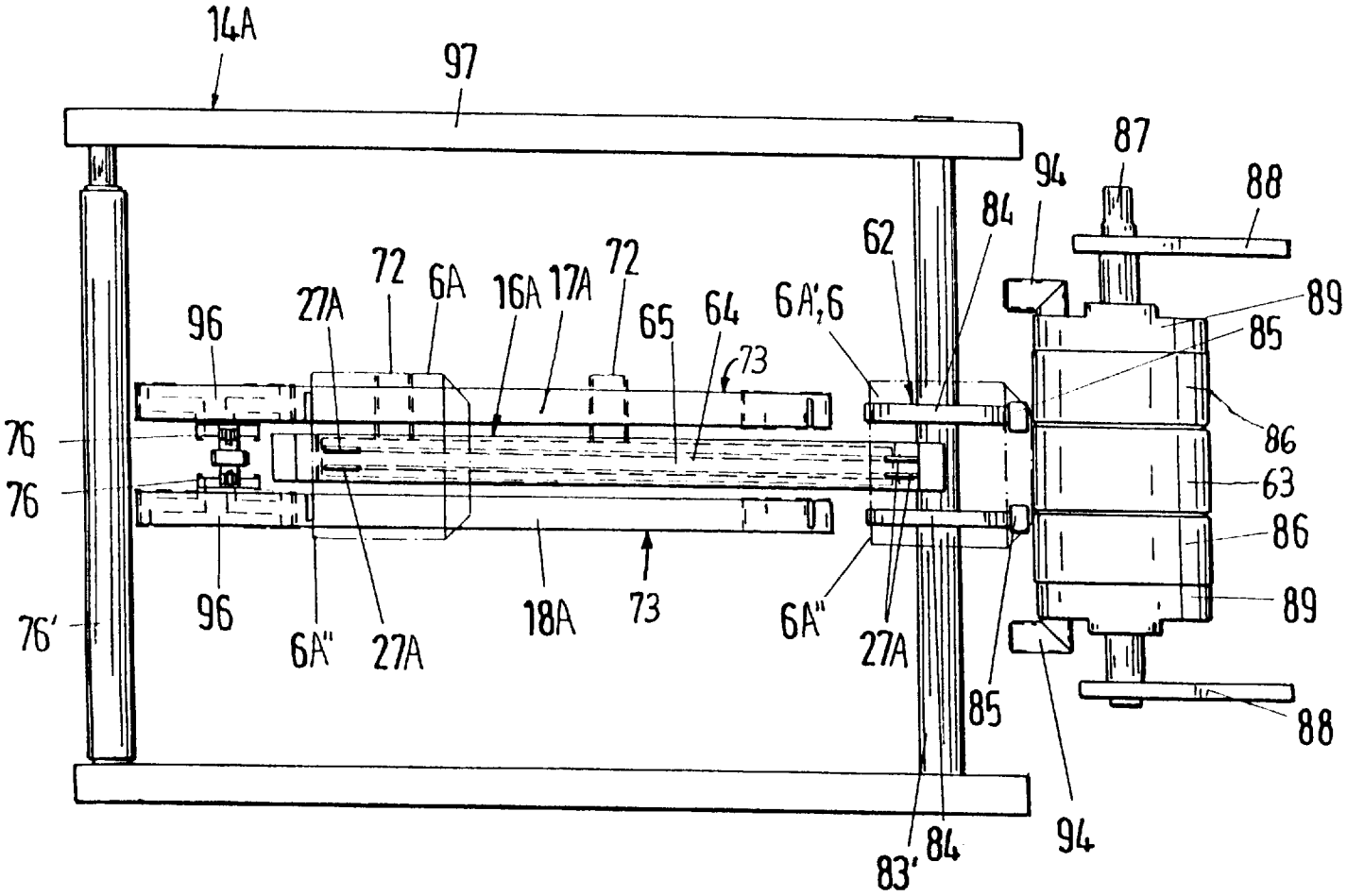
FIG. 6 is a top plan view in the direction of the arrow VI in FIG. 5.
Figure 8:
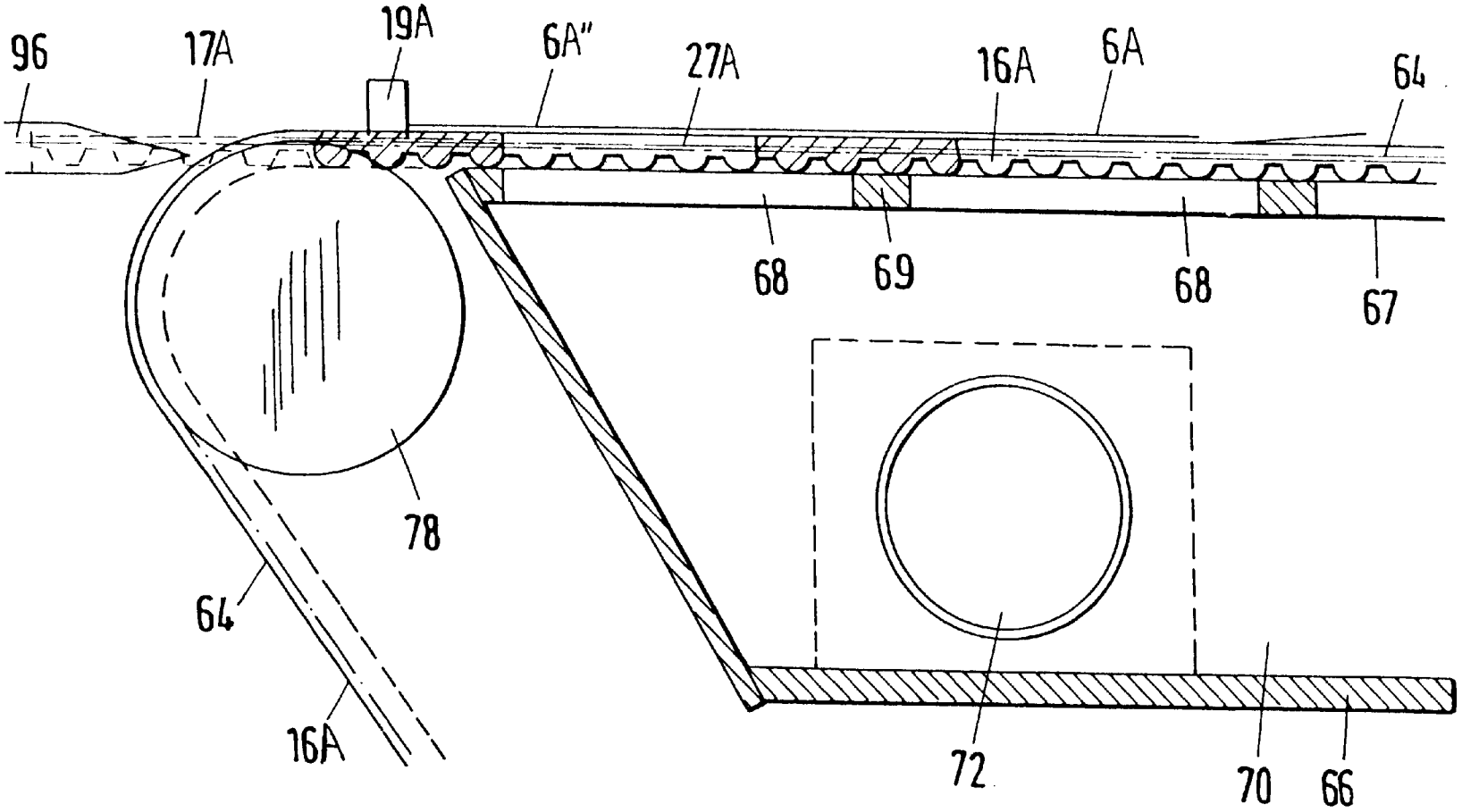
FIG. 8 shows on an enlarged scale the detail VIII of FIG. 5.

As shown in FIG. 6 gear belt 64 of the entrainment member 16A is equipped with suction openings 27A forming a force applicator which entrains a leading edge of an article 6A at an entraining area along the leading edge between the ends of the leading edge or article. The position of the entraining area is determined by the position of the suction openings 27A. For this purpose the suction openings 27A are exposed to reduced pressure that is applied as an article holding force to the suction openings 27A along the length of the alignment path 50' but at least during alignment, that is, where alignment takes place. This holding force permits simultaneously a turning of the article about the entrainment area and a rotating of the article with its leading edge about that stop member 19 which is first contacted by the leading edge of a skewed article. At the same time lateral displacement of the article is prevented. The same operation taks place in the first embodiment shown in FIGS. 1 to 4. A suction box 66 is arranged for applying reduced pressure below the downwardly facing side of the gear belt 64, more specifically on the downwardly facing portion of the upper run 65 of the gear belt 64. The suction box 66 has openings 68 in its upper cover wall 67. The openings 68 are positioned for cooperation with the suction openings 27A in the gear belt 64 when the gear belt 64 moves along the suction box 66. The top cover wall 67 of the suction box 66 is provided with cross-pieces or lands 69 which are spaced from each other to form the suction holes or openings 68 which are relatively long in the feed direction as best seen in FIG. 8. Reduced pressure maintained in the suction box 66 is effective through the openings 68 and through the openings 27A of the gear belt 64 which functions as a suction belt. Thus, reduced pressure prevails at the openings 27A of the gear belt 64 along the length of the alignment path 50' but at least where alignment takes place.

Figure 7:
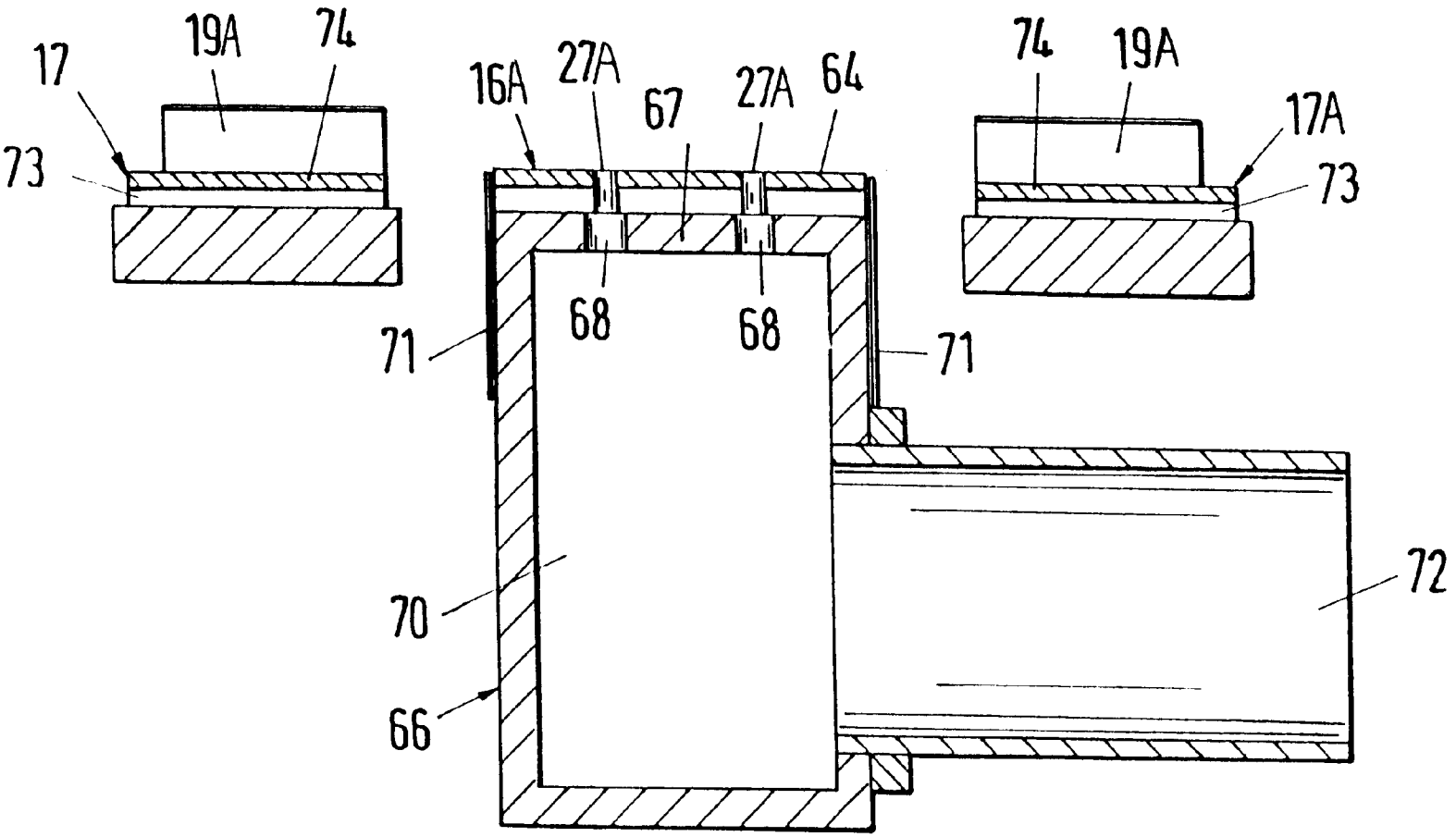
FIG. 7 is a sectional view along section line VII—VII in FIG. 5.

Sealing elements 71 best seen in FIG. 7 are arranged laterally on the suction box 66. These sealing elements 71 function as guides in addition to the sealing of the gear belt 64. Couplings or connector nipples 72 lead through a suction pipe not shown to a source of reduced pressure also not shown.

Referring to FIGS. 6 and 7, a further gear belt 73 is arranged on each side of the gear belt 64 of the entraining mechanism 16A. Thus, the entraining gear belt 64 with its suction openings 27A forming a force applicator is located between the two gear belts 73 as best seen in FIG. 6. With this position of the suction openings 27A in the entraining gear belt 64 each article 6A is preferably entrained centrally in the entraining area along its leading edge between the ends of the leading edge or article to permit the leading edge of an article 6A to turn about the entraining area and to simultaneously rotate about the stop member which is first contacted by the leading edge of a skewed article. At the same time lateral displacement of an article is prevented by the holding force. Each gear belt 73 carries at least one, preferably a plurality of stop members 19A, whereby at least two stop members 19A are provided. Thus, the gear belts 73 form carriers 17A for the stop members 19A. In order to accommodate articles 6A of different size, it is preferable that the spacing between neighboring stop members 19 is adjustable. However, the spacings will be equal to each other around the gear belts 73. Thus, these spacings determine the position and control the advance of the stop members 19A. The stop members 19A can be constructed as integral projections on the gear belts 73. The upper runs 74 of each carrier gear belt 73 move in synchronism with each other in the working plane 61. The suction gear belt 64 also moves in the working plane 61. However, the stop member carrying gear belts 73 move at a slower speed than the suction gear belt 64.

The position and arrangement of the suction openings 27A which function as force applicators in the gear belt 64 is such that the articles to be aligned will be seized along their leading edge 6" at an entraining area between the ends of the leading edge or article, whereby the articles are entrained and transported with the speed of the gear belt 64. This transport at the higher speed along the alignment path 50' takes place until the leading edge 6" contacts a stop member or two stop members 19A and performs simultaneously the above mentioned turning and rotating motions while being prevented to travel laterally. The gear belt 64 continues at its higher speed and there is little slip between the gear belt 64 and the respective article 6A until the article is taken over by rollers 75, 76 for transfer to discharge rollers 75' and 76'.

The lead-out end 77 of the alignment mechanism 14A is equipped with detour rollers 78, 79 for the gear belt 64 and for the gear belts 73. The discharge rollers 75', 76' are positioned in the area of the detour rollers 78, 79. The roller 75 is arranged above the working plane 61 and biased by a spring SB. These rollers 75, 76, and 75', 76' transport the articles out of the alignment mechanism with a speed which is slightly smaller than the speed of the gear belts 73. This features makes sure that the stop members 19A can move below the working plane 61 as the stop members 19A travel around the detour roller 79.

Drive rollers 80 and 81 driven by motors not shown and guide and tensioning rollers 82 and 83 are arranged in the machine frame 45 as shown in FIG. 5 for operating the above described gear belts which are mounted on the above mentioned rollers in the machine frame 45 in conventional bearings and guide elements not shown.

Referring further to FIGS. 5 and 6, the segment roller 62 for withdrawing the articles individually from the staggered arrangement 6A' preferably comprises two disks 84 fixedly mounted on a shaft 83' which drives the disks that carry on their circumference sectors or segment elements 85. The suction roller 63 cooperating with the segment roller 62 comprises a suction cylinder 86 which is mounted rigidly to a drive shaft 87 that rotates the suction cylinder 86. As mentioned, the drive shaft 87 is mounted at it ends in tilting arms 88 as best seen in FIG. 6, showing the suction roller 63 in a tilted-away position compared to FIG. 5. Suction control valves 89 are arranged at each end of the suction cylinder 86 as shown in FIG. 6. These suction control valves 89 do not rotate with the shaft 87 nor with the suction cylinder 86.

As shown in FIG. 5, suction channels 90 are positioned close to the outer circumferential rim in the suction cylinder 86. These suction channels 90 extend from end-to-end through the cylinder 86 and communicate with radial bores 91 in the cylinder rim 92 to form the respective suction holes.

In operation, when the suction cylinder 86 rotates, the suction channels 90 are sequentially exposed to reduced pressure followed by exposure to atmospheric pressure. Valves 89 control the application of reduced pressure and are equipped with a short suction channel 93 which communicates with a suction pipe nipple 94 to supply the respective reduced pressure to the suction holes. The control valves 89 are further equipped with a channel 95 for periodically venting the suction channels 90 in the suction cylinder 86 to the atmosphere.

In operation, when reduced pressure is applied to the suction channels 90, the articles are seized one-by-one by the suction roller 63 positioned centrally in the suction cylinder 86. As an article 6A is seized, it is lifted out of the staggered arrangement 6A' shown in FIG. 5. This lifting has the advantage that any jamming or interlocking of neighboring articles, especially letter envelopes with window openings, is avoided. The cooperation of the rollers 62 and 63 thus removes one article at a time from the staggered arrangement 6A'. As soon as the suction channels 90 are vented to atmosphere, the letter envelope blanks 6A are transferred to the entraining mechanism 16A formed by the gear belt 64, whereupon the alignment takes place by the cooperation between the gear belts 64 and 73 when the articles bear with their leading edge 6" against the stops 19A as described.

Guide plates 96, machine frame members 97, and similar components are conventional and hence not described in further detail.

Although the invention has been described with reference to specific example embodiments, it will be appreciated that it is intended to cover all modifications and equivalents within the scope of the appended claims.

What is claimed is:

1. A method for aligning flat articles each having a leading edge as viewed in a transport direction and an entraining area along said leading edge between ends of said leading edge, said method comprising the following steps:

(a) transporting said flat articles with a first speed along an alignment path with said leading edge facing in said transport direction, (b) simultaneously moving at least two stop members along said alignment path with a second speed that is lower than said first speed to provide a relative motion between said articles and said at least two stop members, (c) applying a holding force to said entraining area along said leading edge holding each individual flat article at least during its alignment thereby preventing a lateral displacement of said flat articles during alignment while still permitting a turning of said flat articles about said entraining area, (d) first pulling said flat articles one after another with said leading edge against one stop member of said at least two stop members moving at said lower speed, and (e) further pulling and thereby rotating said leading edge against the other stop member of said at least two stop members while still preventing said lateral displacement of said flat article, whereby said turning and rotating aligns said leading edge of each article against said at least two stop members.

2. The method of claim 1, wherein said transporting of said articles with said first speed and said transporting of said at least two stop members with said second speed are performed along a curved path forming said alignment path.

3. The method of claim 1, wherein said transporting of said articles with said first speed and said transporting of said at least two stop members with said second speed are performed along a straight, plane path forming said alignment path.

4. The method of claim 1, further comprising generating said holding force by suction air applied to said entraining area at least during said turning and rotating of said article during alignment.

5. The method of claim 1, further comprising producing a further relative motion between said articles and said at least two stop members for separating an aligned article from said at least two stop members.

6. The method of claim 5, wherein said further relative motion is caused by reducing a speed of an aligned article.

7. The method of claim 1, further comprising separating an aligned article from said at least two stop members by moving said at least two stop members temporarily out of said alignment path.

8. An apparatus for aligning flat articles having a leading edge as viewed in a transport direction and an entraining area along said leading edge between ends of said leading edge, said apparatus comprising an article transport mechanism for moving said articles in said transport direction, a first drive (22) connected to said transport mechanism for driving said transport mechanism with a first speed in said transport direction, two parallel carrier members with a spacing between said carrier members, at least two stops arranged so that at least one stop is carried by each of said parallel carrier members for moving said at least two stops in parallel to said transport mechanism, a second drive connected to said parallel carrier members for moving said parallel carrier members at a second speed slower than said first speed, said transport mechanism including a force applicator positioned in said spacing between said two parallel carrying members applying a holding force to said entraining area along said leading edge to hold each individual flat article at least during its alignment against a lateral displacement while simultaneously permitting a turning of the flat article about said entraining area, said transport mechanism driven by said first drive first pulling said leading edge against one of said at least two stops and then rotating said leading edge against the other stop of said at least two stops to thereby align said articles one after another against both stop members.

9. The apparatus of claim 8, wherein said force applicator comprises suction holes (27) for applying reduced pressure through said suction holes (27) to said entraining area thereby generating said holding force that prevents said lateral displacement but permits said turning about said entraining area and said rotating of said leading edge at least during said alignment.

10. The apparatus of claim 8, wherein said article transport mechanism comprises an article transport disk or drum (16'), and wherein said at least two carrier members for moving said at least two stops comprise two carrier disks (17') to which said stops are secured, said carrier disks being spaced from each other by said spacing, said transport disk or drum (16') being positioned between said carrier disks.

11. The apparatus of claim 10, further comprising a shaft (20) and bearings rotatably mounting said transport disk or drum (16') on said shaft (20) for permitting rotation of said transport disk or drum (16') relative to said shaft (20), said first drive comprising drive elements (22, 23, 22', 22") operatively connected to said transport disk or drum (16) for driving said transport disk or drum at said first speed, and wherein said carrier disks (17', 18') are rigidly mounted on said shaft (20) for rotation with said shaft, and wherein said second drive is connected to said shaft (20) for driving said carrier disks (17', 18') at said second lower speed.

12. The apparatus of claim 10, wherein said article transport disk or drum (16') comprises a circumferential rim (26) and at least one row of suction openings (27) forming said force applicator in said rim (26) and a suction channel (28) for communicating said suction openings (27) with a source of reduced pressure, said suction channel (28) having an axially facing opening (29), a stationary suction head (32) connectable to said source of reduced pressure, and wherein at least one carrier disk (17') of said at least two carrier disks comprises suction ducts (38, 39, 40, 43) for communicating said suction channel (28) through said suction ducts (38, 39, 40, 43) with said stationary suction head (32) periodically when said at least one carrier disk (17') rotates.

13. The apparatus of claim 12, wherein said suction ducts in said at least one carrier disk (17') comprise at least one suction segment (41) forming a suction window (43) that is circumferentially wide enough to overlap at least one said suction channel (28) completely or two neighboring suction channels (28, 28') at least partly.

14. The apparatus of claim 13, wherein said at least one carrier disk (17') comprises three suction segments (41, 41', 41") and respective suction duct sections (39', 40) for communicating said suction segments with said suction head (32).

15. The apparatus of claim 8, wherein said article transport mechanism comprises at least one entraining gear belt (64) including a suction opening (27A) forming said force applicator in said at least one entraining gear belt for applying said entraining force to said entraining area of said article.

16. The apparatus of claim 15, wherein said two carrier members comprise at least two carrier gear belts (73), each carrier gear belt carrying at least one stop of said at least two stops, said carrier gear belts being spaced from each other by said spacing, said at least one entraining gear belt (64) being positioned in said spacing.

* * * * *